US008379798B2

(12) United States Patent
Murthy et al.

(10) Patent No.: US 8,379,798 B2
(45) Date of Patent: Feb. 19, 2013

(54) MOVING HIGH FLUX X-RAY TARGET AND ASSEMBLY

(75) Inventors: Maheshwara Murthy, Bangalore (IN); Prasad Balaji Narasimha Paturi, Bangalore (IN); Anupam Singh Ahlawat, Bangalore (IN)

(73) Assignee: General Electric Company, Schenectady, NY (US)

( * ) Notice: Subject to any disclaimer, the term of this patent is extended or adjusted under 35 U.S.C. 154(b) by 206 days.

(21) Appl. No.: 12/810,869

(22) PCT Filed: Dec. 31, 2007

(86) PCT No.: PCT/IN2007/000626

§ 371 (c)(1),
(2), (4) Date: Jun. 28, 2010

(87) PCT Pub. No.: WO2009/083998

PCT Pub. Date: Jul. 9, 2009

(65) Prior Publication Data

US 2010/0284517 A1 Nov. 11, 2010

(51) Int. Cl.
*H01J 35/00* (2006.01)

(52) U.S. Cl. ..... 378/125; 378/126; 378/131

(58) Field of Classification Search ..... 378/119, 378/121, 125, 126, 127, 131
See application file for complete search history.

(56) References Cited

U.S. PATENT DOCUMENTS

| | | | |
|---|---|---|---|
| 2,290,226 | A | 7/1942 | Du Mond |
| 5,822,395 | A | 10/1998 | Schardt et al. |

FOREIGN PATENT DOCUMENTS

| | | | |
|---|---|---|---|
| DE | 1193616 | B | 5/1965 |
| DE | 2252911 | A1 | 5/1974 |
| DE | 3638378 | | 5/1988 |
| FR | 1001622 | A | 2/1952 |
| JP | 52059593 | | 5/1977 |
| JP | 52110578 | A | 9/1977 |
| JP | 56021324 | | 2/1981 |
| JP | 2003007237 | | 1/2003 |

OTHER PUBLICATIONS

PCT/IN07/00626; Search Report & Written Opinion, Oct. 1, 2008.
English translation of JP Notice of Allowance dated Oct. 23, 2012 listing the references cited above.

*Primary Examiner* — Jurie Yun
(74) *Attorney, Agent, or Firm* — General Electric Company; Sushupta T. Sudarshan; David J. Clement

(57) ABSTRACT

An X-ray tube anode target assembly having a support shaft connected to a pivot assembly and a movable anode target surface disposed at one end of the support shaft. A first drive assembly is operably arranged with respect to the support shaft to provide oscillatory motion to the anode target about a first axis substantially parallel to the support shaft and drive cylinder operably arranged with respect to the contact element to provide a pivoting motion to the support shaft. A second drive assembly is operably arranged with respect to the drive cylinder to provide an oscillatory motion to the drive cylinder, the second drive cylinder having a cam portion to provide linear motion to the support shaft parallel to the first axis. The target surface is maintained at a substantially constant angle of impingement and maintains a substantially fixed distance from a cathode during target motion.

16 Claims, 6 Drawing Sheets

MOVING HIGH FLUX X-RAY TARGET AND ASSEMBLY

FIELD OF THE INVENTION

This disclosure relates to an X-ray tube anode target assembly and, more particularly, to configuration and structures for imparting motion to an X-ray tube anode target assembly.

BACKGROUND

Ordinarily, an X-ray beam-generating device referred to as an X-ray tube comprises dual electrodes of an electrical circuit in an evacuated chamber or tube. One of the electrodes is an electron emitter cathode which is positioned in the tube in spaced relationship to an anode target. Upon energization of the electrical circuit generates a stream or beam of electrons directed towards the anode target. This acceleration is generated from a high voltage differential between the anode and cathode that may range from 60-450 kV, which is a function of the imaging application. The electron stream is appropriately focused as a thin beam of very high velocity electrons striking the anode target surface. The anode surface ordinarily comprises a predetermined material, for example, a refractory metal so that the kinetic energy of the striking electrons against the target material is converted to electromagnetic waves of very high frequency, i.e., X-rays, which proceed from the target to be collimated and focused for penetration into an object usually for internal examination purposes, for example, industrial inspection procedures, healthcare imaging and treatment, or security imaging applications, food processing industries. Imaging applications include, but are not limited to, Radiography, CT, X-ray Diffraction with Cone and Fan beam x-ray fields.

Well-known primary refractory and non-refractory metals for the anode target surface area exposed to the impinging electron beam include copper (Cu), Fe, Ag, Cr, Co, tungsten (W), molybdenum (Mo), and their alloys for X-ray generation. In addition, the high velocity beam of electrons impinging the target surface generates extremely high and localized temperatures in the target structure accompanied by high internal stresses leading to deterioration and breakdown of the target structure. As a consequence, it has become a practice to utilize a rotating anode target generally comprising a shaft supported disk-like structure, one side or face of which is exposed to the electron beam from the thermionic emitter cathode. By means of target rotation, the impinged region of the target is continuously changing to avoid localized heat concentration and stresses and to better distribute the heating effects throughout the structure. Heating remains a major problem in X-ray anode target structures. In a high speed rotating target, heating must be kept within certain proscribed limits to control potentially destructive thermal stresses particularly in composite target structures, as well as to protect low friction, solid lubricated; high precision bearings that support the target.

Only about 1.0% of the energy of the impinging electron beam is converted to X-rays with the remainder appearing as heat, which must be rapidly dissipated from the target essentially by means of heat radiation. Accordingly, significant technological efforts are expended towards improving heat dissipation from X-ray anode target surfaces. For most rotating anode targets heat management must take place principally through radiation and a material with a high heat storage capacity. Stationary anode target body configurations or some complex rotating anode target configurations may be designed to have heat transfer primarily take place using conduction or convection from the target to the x-ray tube. Life of rotating x-ray targets are often gated by the complexities of rotation in a vacuum. Traditional x-ray target bearings are solid lubricated, which have relatively low life. Stationary targets do not have this life-limiting component, at the cost of lower performance.

Other rotation components, solid lubricated bearings, ferro-fluid seals, spiral-grooved liquid metal bearings, etc, all introduce manufacturing complexity and system cost.

What is needed is a high flux X-ray tube configuration that provides motion to the target and includes components capable of maintaining an extended life, with a limited introduction of cost and manufacturing complexity.

SUMMARY OF THE DISCLOSURE

A first aspect of the disclosure includes an X-ray tube anode target assembly having a support shaft connected to a pivot assembly and a movable anode target having a target surface disposed at one end of the support shaft. The assembly further includes a first drive assembly operably arranged with respect to the support shaft to provide oscillatory motion to the anode target about a first axis substantially parallel to the support shaft and drive cylinder operably arranged with respect to the contact element to provide a pivoting motion to the support shaft. A second drive assembly is operably arranged with respect to the drive cylinder to provide a oscillatory motion to the drive cylinder, the second drive cylinder being further configured to provide a linear motion parallel to the first axis. The target surface is maintained at a substantially constant angle of impingement and maintains a substantially fixed distance from a cathode during target motion.

Another aspect of the disclosure includes an X-ray tube assembly including an envelope having at least a portion thereof substantially transparent to X-ray, a cathode assembly, operatively positioned in the envelope with an anode target assembly. The anode target assembly includes a support shaft connected to a pivot assembly and a movable anode target having a target surface disposed at one end of the support shaft. The assembly further includes a first drive assembly operably arranged with respect to the support shaft to provide oscillatory motion to the anode target about a first axis substantially parallel to the support shaft and drive cylinder operably arranged with respect to the contact element to provide a pivoting motion to the support shaft. A second drive assembly is operably arranged with respect to the drive cylinder to provide a oscillatory motion to the drive cylinder, the second drive cylinder being further configured to provide a linear motion parallel to the first axis. The target surface is maintained at a substantially constant angle of impingement and maintains a substantially fixed distance from a cathode during target motion.

Another aspect of the disclosure includes a method for providing heat management to an X-ray assembly. The method includes providing an X-ray tube assembly having an envelope having at least a portion thereof substantially transparent to X-ray, a cathode assembly, operatively positioned in the envelope and an anode target assembly. The anode target assembly includes a support shaft connected to a pivot assembly and a movable anode target having a target surface disposed at one end of the support shaft. The assembly further includes a first drive assembly operably arranged with respect to the support shaft to provide oscillatory motion to the anode target about a first axis substantially parallel to the support shaft and drive cylinder operably arranged with respect to the contact element to provide a pivoting motion to the support shaft. A second drive assembly is operably arranged with respect to the drive cylinder to provide a oscillatory motion to the drive cylinder, the second drive cylinder being further configured to provide a linear motion parallel to the first axis. The method further includes providing motion to the anode target assembly and maintaining a substantially constant angle of impingement and maintaining a substantially fixed distance from the cathode during target motion.

The position of the focal point along the surface of the target is varied, providing improved heat management, wherein the heat may be dissipated more easily. In addition, the increased dissipation permits the use of higher power and longer durations than are available with the use of a stationary anode arrangement. In addition, the anode has increased life over anodes that have a fixed focal point on the anode. The anode target motion provides longer life than solid lubricated bearings used in known rotating anode sources.

Another advantage of the present disclosure includes the reduction or elimination in dwell or delay time for anode motion reducing or eliminating heat build up due to reversal of direction. In addition, cooling may be accomplished primarily or exclusively through radiative cooling.

The assembly of the present disclosure may allow multiple spots to be placed on a single target, in that each region will be thermally isolated from the neighboring spot, while maintaining the benefit of higher power through oscillatory motion from a single drive mechanism.

Embodiments of the present disclosure also allow the distribution of heat over a larger area of the anode target, through the oscillating motion, which reduces the peak temperature and maintains the temperature below the evaporation limit for the metal in the envelope, and reduces the temperature gradient between surface and substrate Other features and advantages of the present disclosure will be apparent from the following more detailed description of the preferred embodiment, taken in conjunction with the accompanying drawings which illustrate, by way of example, the principles of the disclosure.

BRIEF DESCRIPTION OF THE DRAWINGS

Wherever possible, the same reference numbers will be used throughout the drawings to refer to the same or like parts.

DETAILED DESCRIPTION

Figure 1:
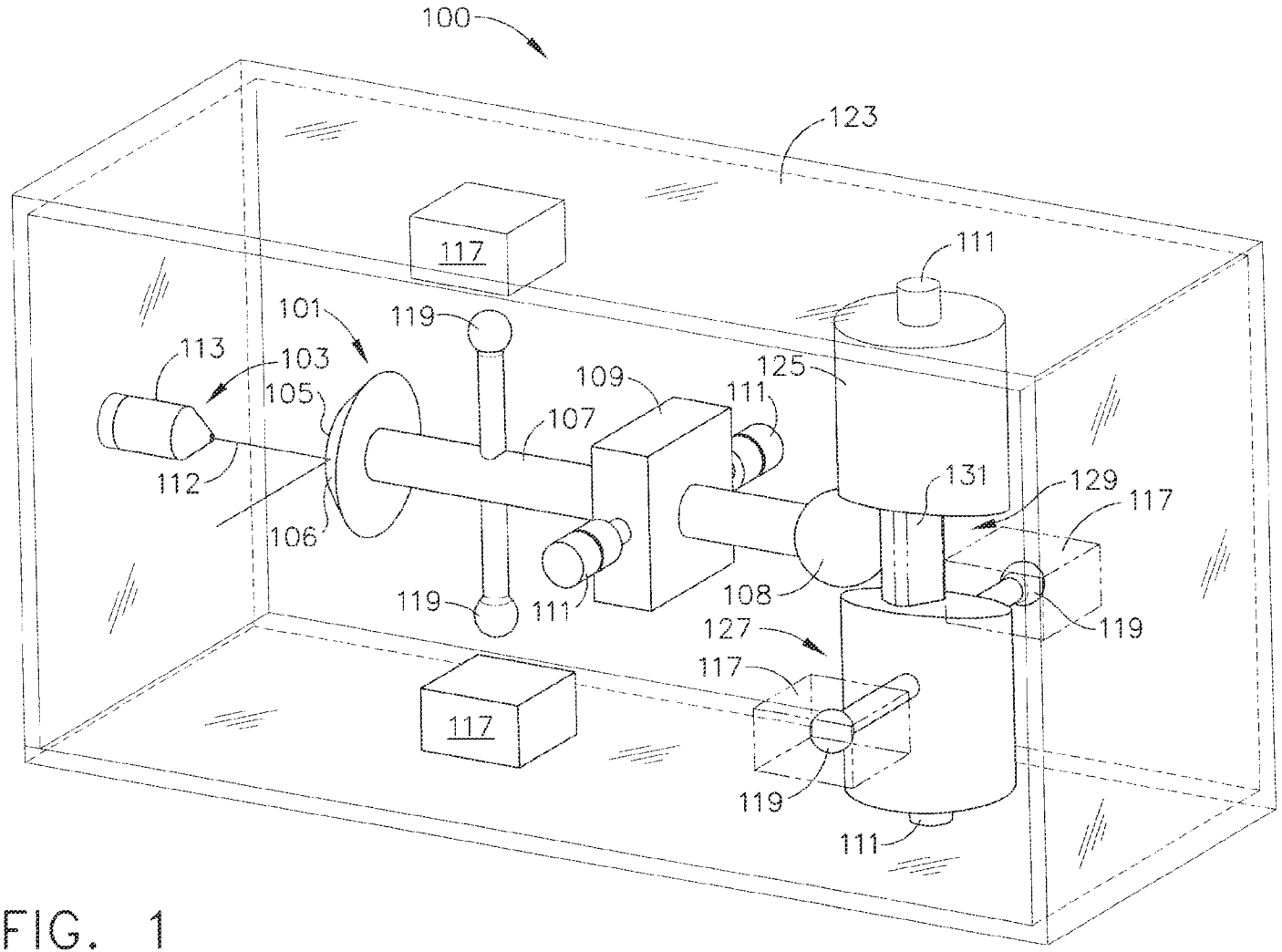
FIG. 1 shows a perspective view of an X-ray tube assembly according to an embodiment of the present disclosure.

FIG. 1 is a perspective view of an X-ray tube assembly 100 having an anode assembly 101 and a cathode assembly 103. The anode assembly 101 and cathode assembly 103 are arranged in a manner, through thermionic or field-emission electron generation, that permits formation of X-rays, during X-ray tube assembly 100 operation. The anode assembly 101 includes an anode target 105 mounted on a support shaft 107. The anode target 105 is fabricated from any material suitable for use as an anode target, such as, but not limited to copper (Cu), iron (Fe), silver (Ag), chromium (Cr), cobalt (Co), tungsten (W), molybdenum (Mo), and their alloys. For example, tungsten or molybdenum having additive refractory metal components, such as, tantalum, hafnium, zirconium and carbon may be utilized. The suitable materials may also include oxide dispersion strengthened molybdenum and molybdenum alloys, which may further include the addition of the addition of graphite to provide additional heat storage. Further still, suitable material may include tungsten alloys having added rhenium to improve ductility of tungsten, which may be added in small quantities (e.g., 1 to 10 wt %). A bulbous protrusion follower element 108 is mounted on the support shaft 107 distal to the target 105.

Figure 2:
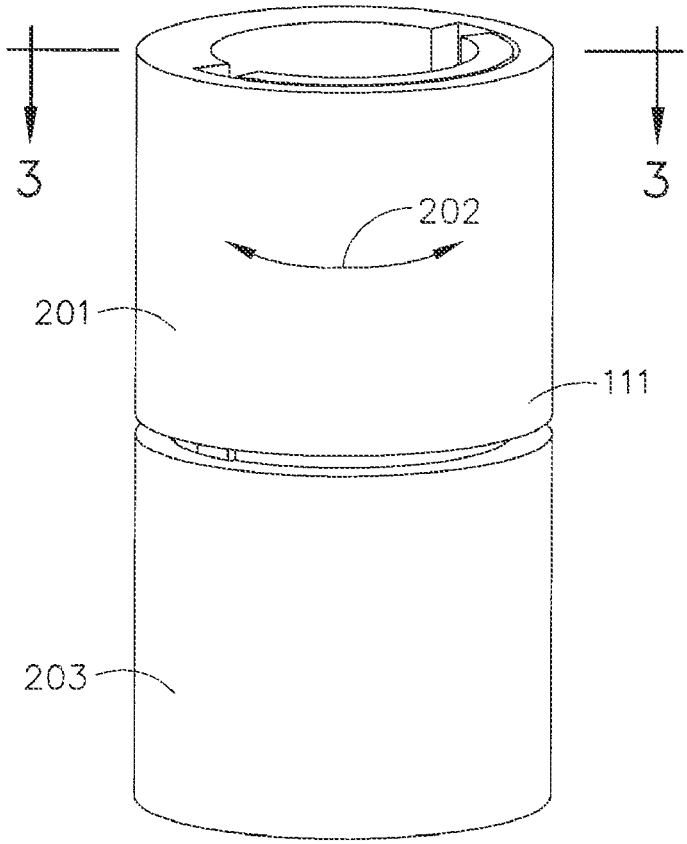
FIG. 2 shows an oscillatory coupling according to an embodiment of the present disclosure.
Figure 3:
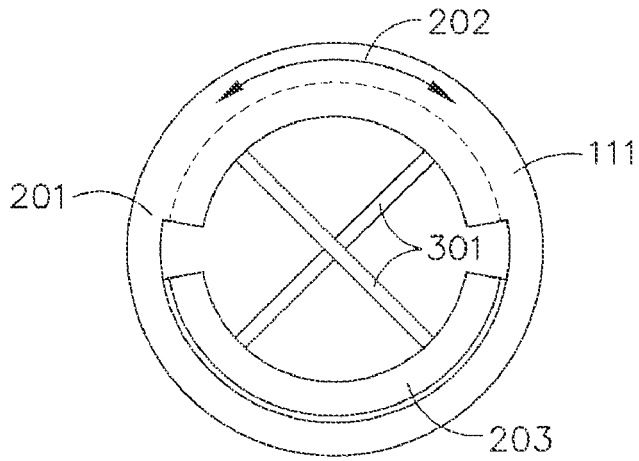
FIG. 3 shows a view of an anode assembly taken along line 3-3 of FIG. 2 according to an embodiment of the present disclosure.

The support shaft 107 is mounted on a pivot assembly 109 with two oscillatory couplings 111 (see e.g., FIGS. 2-3). The oscillatory couplings 111 include a first portion 201 (see FIG. 2) that are attached to the pivot assembly 109 and a second portion 203 (see FIG. 2) of the oscillatory coupling 111 attached to housing to the X-ray tube assembly 100. The arrangement of oscillatory couplings 111 permits the pivot assembly 109 to oscillate. By "oscillatory", "oscillation", "oscillate" and grammatical variations thereof, it is meant to include swaying motion to and fro, rotation or pivoting on an axis between two or more positions and/or motion including periodic changes in direction. By "pivot", "pivoting" and grammatical variations thereof, it is meant to be a rotary or turning motion about a single location or single area.

The anode target 105 includes a target surface 106 that is arranged in a frusto-conical geometry. Although FIG. 1 includes a frusto-conical geometry for the target surface 106, other geometries may be utilized as long as the target surface 106 includes an angled surface. Other suitable geometries include, but are not limited to conical, conical segments, wedge, pyramidal, or other angled geometry, including multiple distinct surfaces having suitable geometries. The target surface 106 is the surface onto which an electron beam 112 is directed. The electron beam 112 is directed to the target surface 106 from cathode assembly 103.

The cathode assembly 103 comprises an electron emissive portion 113. The disclosure is not limited to the arrangement shown, but may be any arrangement and/or geometry that permits the formation of an electron beam at the electron emissive portion 113. Conductors or other current supplying mechanism may be included, in the cathode assembly 103 to supply heating current to a filament and/or conductor present in the cathode assembly for maintaining the cathode at ground or negative potential relative to the anode target 105 of the tube assembly 100. An electron beam 112 from the electron emissive portion 113 impinges upon target 105 at a focal point on the target surface 106 to produce X-radiation. The target surface 106 is configured with a substantially constant angle of impingement (see e.g., FIG. 7) by the electron beam 112, throughout the anode target 105 motion. The beam 112 produces X-radiation by impingement on target 105, wherein the X-radiation is directed through a window (not shown).

At least a portion of the envelope 123 acts as a window 121 for the X-rays. The window may be fabricated from glass or other material substantially transparent to X-rays. The configuration of the envelope 123 may be any configuration -suitable for providing the X-radiation to the desired locations and may be fabricated from conventionally utilized materials.

The focal point may be a single point or an area having any suitable geometry corresponding to the electron emissions from the electron emissive portion 113. Additionally, the focal point may have movement introduced into the beam from electrostatic, magnetic or other steering method. In addition, the focal point may be of constant size and/or geometry or may be varied in size and/or geometry, as desired for the particular application. "X-ray", "X-radiation" and other grammatical variations as utilized herein mean electromagnetic radiation with a wavelength in the range of about 10 to 0.01 nanometers or other similar electromagnetic radiation. Heat is generated along the target surface 106 at the point of electron beam contact (i.e., the focal point). The anode target 105 is oscillated by a first drive assembly 115, which may include, but is not limited to, an induction or otherwise magnetically or mechanically driven drive mechanism. Suitable drive assemblies 115 may include, but are not limited to, voice-coil actuators or switched reluctance motors (SRM) drive. The first drive assembly 115 may further, include cams or other structures to convert linear, rotational or other motion to oscillatory motion.

The first drive assembly 115 includes an arrangement capable of providing oscillatory motion to the target 105. In the arrangement shown, the first drive assembly 115 includes a magnetically driven motor arrangement, including fixed stator portions 117 and a movable ball portion 119. The movable ball portion 119 is preferably a ferromagnetic or otherwise magnetic material that is capable of attraction to the stator portions 117 upon electromagnetic activation thereof. The ball portion 119 is disposed at a distal end of the support shaft 107 to the target 105. The drive assembly 115 is operably arranged to provide the oscillatory motion for the attached target 105. The oscillating motion about first axis 404 (see e.g., FIG. 4) moves the target 105 in a direction that maintains a fixed distance to the cathode assembly 103, allowing additional area of the target surface 106 to receive the electron beam 112.

The target assembly further includes a drive cylinder 125 arranged in contact with the follower element 108. The drive cylinder 125 is mounted to the X-ray tube assembly 100 by two oscillatory couplings 111. The oscillatory couplings 111 are arranged to permit oscillation of the drive cylinder. A second drive assembly 127 is arranged to provide the oscillatory motion to the drive cylinder 125. The second drive assembly 127, which, like first drive assembly 115, includes a stator portion 117 and a ball portion 119. The ball portion 119 is connected to drive assembly 127 and provides an oscillatory motion to the drive cylinder. The drive cylinder 125 further includes a groove 129 which is configured to receive at least a portion of follower element 108. The groove is configured with a slope that is non-perpendicular to the second axis 406 (see e.g., FIG. 4). The follower element 108 engages groove 129 and translates the oscillatory (i.e. rotational motion) to a linear motion substantially parallel to the second axis (see e.g., FIG. 4). The resultant linear motion provides a pivoting of the support shaft 107 about the pivot assembly 109. The pivoting motion about the pivot assembly 109 moves the target 105 in a direction that maintains a fixed distance to the cathode assembly 103, allowing additional area of the target surface 106 to receive the electron beam 112.

In addition to the groove, the drive cylinder 125 includes a cam portion 131 having a symmetrical or asymmetrical geometry offset from the center of the second axis 406. The cam portion 131 provides a linear motion along the axis of the support shaft 107 (e.g., the cam portion 131 is configured to provide a linear motion parallel to the first axis). The linear motion along the first axis 404 (see e.g., FIG. 4) moves the target 105 in a direction toward the cathode assembly 103, allowing additional area of the target surface 106 to receive the electron beam 112. A spring or other force providing device (not shown) mounted at the pivot assembly 109 or elsewhere may be utilized to maintain engagement of the follower element 108 and the groove 129 and/or cam element 131.

Figure 8:
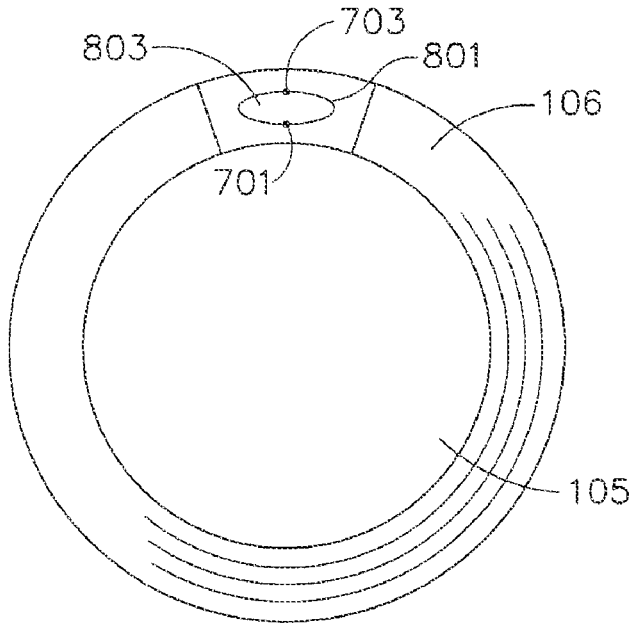
FIG. 8 shows an anode target according to an embodiment of the present disclosure.

The present disclosure is not limited to the arrangement of first and second drive assemblies 115, 127 shown and may include any arrangement capable of providing oscillating motion to the target 105. The drive assemblies 115, 127 may be controlled by any suitable control arrangement including microprocessor or other control device, wherein the motions may be controlled to provide the desired pivoting motion in order to provide a focal path 801 (see e.g., FIG. 8) that permits heat dissipation and minimize or eliminate heat generated damage to the target surface 106.

It is noted that while the individual components discussed above move the target 105 in a direction at a fixed distance from the cathode assembly 103 or in a direction toward (or away from) the cathode assembly 103, the motions may be provided simultaneously, wherein both motions take place, wherein the motions are both in a direction at a fixed distance from the cathode assembly 103 and away or toward the cathode assembly 103.

The movement of the target 105 provided by the first drive assembly 115 is such that the focal point on the target surface 106 provides a substantially constant X-ray emission, wherein the target 105 moves relative to the focal point. In addition, the angle of incidence for the electron beam is maintained during anode target motion 105. Specifically, the first drive assembly 115 provides motion to target 105 such that the focal point remains at a substantially fixed distance from the electron emissive portion 113 and/or the angle at which the electron beam impinges the target 105 remains substantially constant. The present disclosure is not limited to reflection based geometry for X-ray generation, but may include alternate configurations, such as anode target 105 configured for transmission generated X-rays. The anode assembly and the cathode assembly 103 are housed in an envelope 123, which is under vacuum or other suitable atmosphere.

FIG. 2 shows an oscillatory coupling 111 for use in an embodiment of the disclosure. The oscillatory coupling 111 provides a spring-like back and forth oscillatory motion 202 between segments 201, 203 of the oscillatory coupling 111. The oscillatory coupling 111 includes a first segment 201 that rotates with respect to a second segment 203 by segment oscillation 202. During oscillation, the second segment 203 remains substantially stationary. In particular, the second segment 203 is attached to a fixture or other support that retards movement of the second segment 203, while first segment 401 is permitted to oscillate. FIG. 3 shows oscillatory coupling 111 taken along 3-3 of FIG. 2. The oscillatory coupling 111 provides oscillatory motion 202 by a coupling mechanism 301 between the first segment 201 and the second segment 203. The coupling mechanism 301 may be one or more spring or force providing or otherwise flexible devices that provide connection between segments 201, 203 and reciprocating motion between segments 201, 203. In the embodiment shown in FIGS. 2-3, a linear spring is utilized to provide flexing sufficient to provide oscillatory motion 202. The oscillatory coupling mechanism 301 may include linear springs selected to introduce motion that may be varied for desired frequency, angle and path radii.

Coupling mechanisms 301, for example, utilizing linear springs to provide oscillation, may have up to infinite life spans for a prescribed radial load and oscillating angle, which life spans are difficult or impossible in known rotary motion assemblies. During operation of X-ray tube assembly 100, the first drive assembly 115, which is configured to pivot the target 195 in a manner that results in flexing of the coupling mechanism 501 of the corresponding oscillatory couplings 111, which, permits motion of the first segment 401 (i.e. oscillation 402) with respect to the second segment 403. The oscillation of the first segment 401 provides target 105 with motion desirable for heat management.

Figure 4:
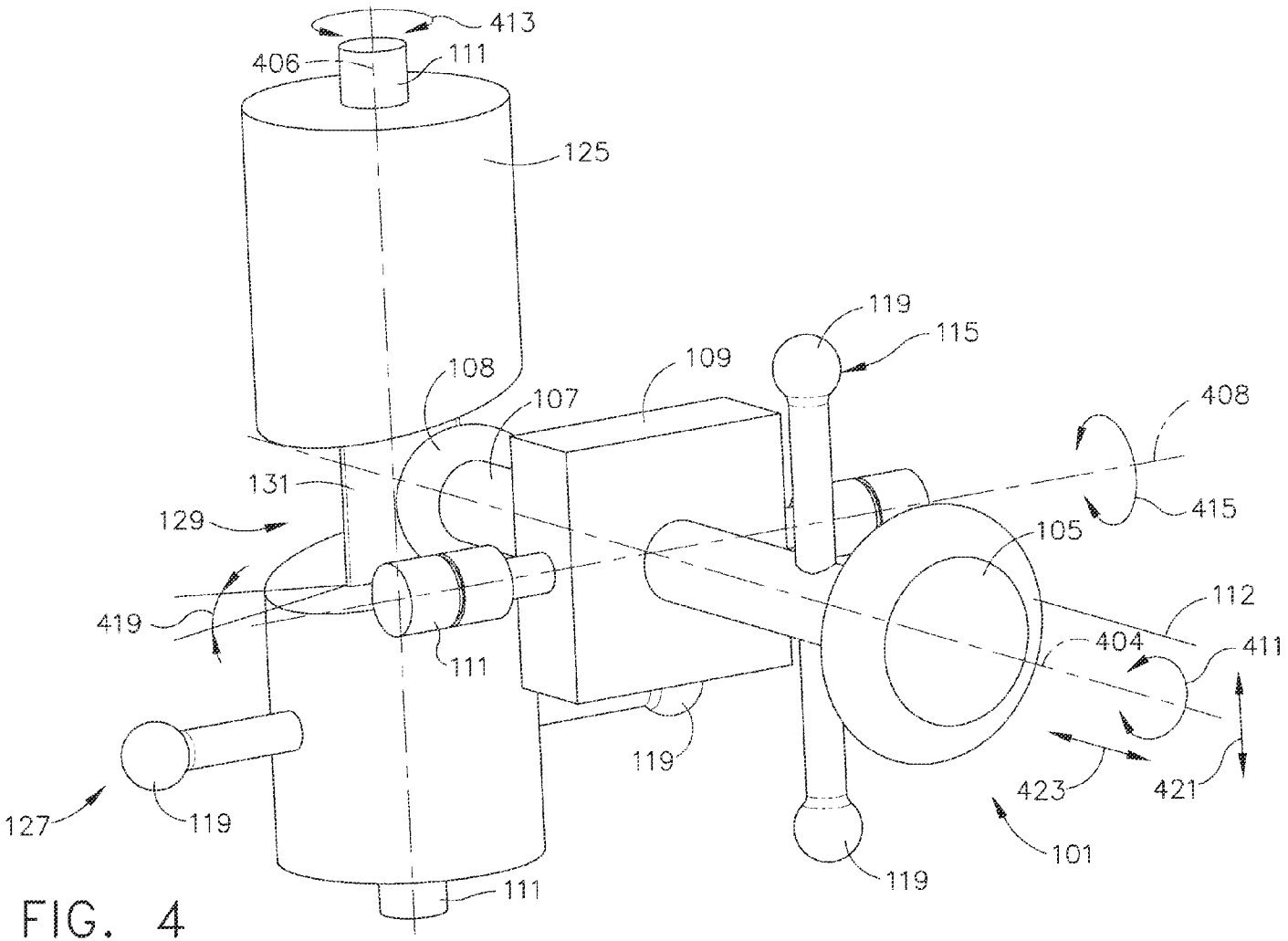
FIG. 4 shows a perspective view an anode target assembly according to an embodiment of the present disclosure taken in a direction toward the anode target.
Figure 5:
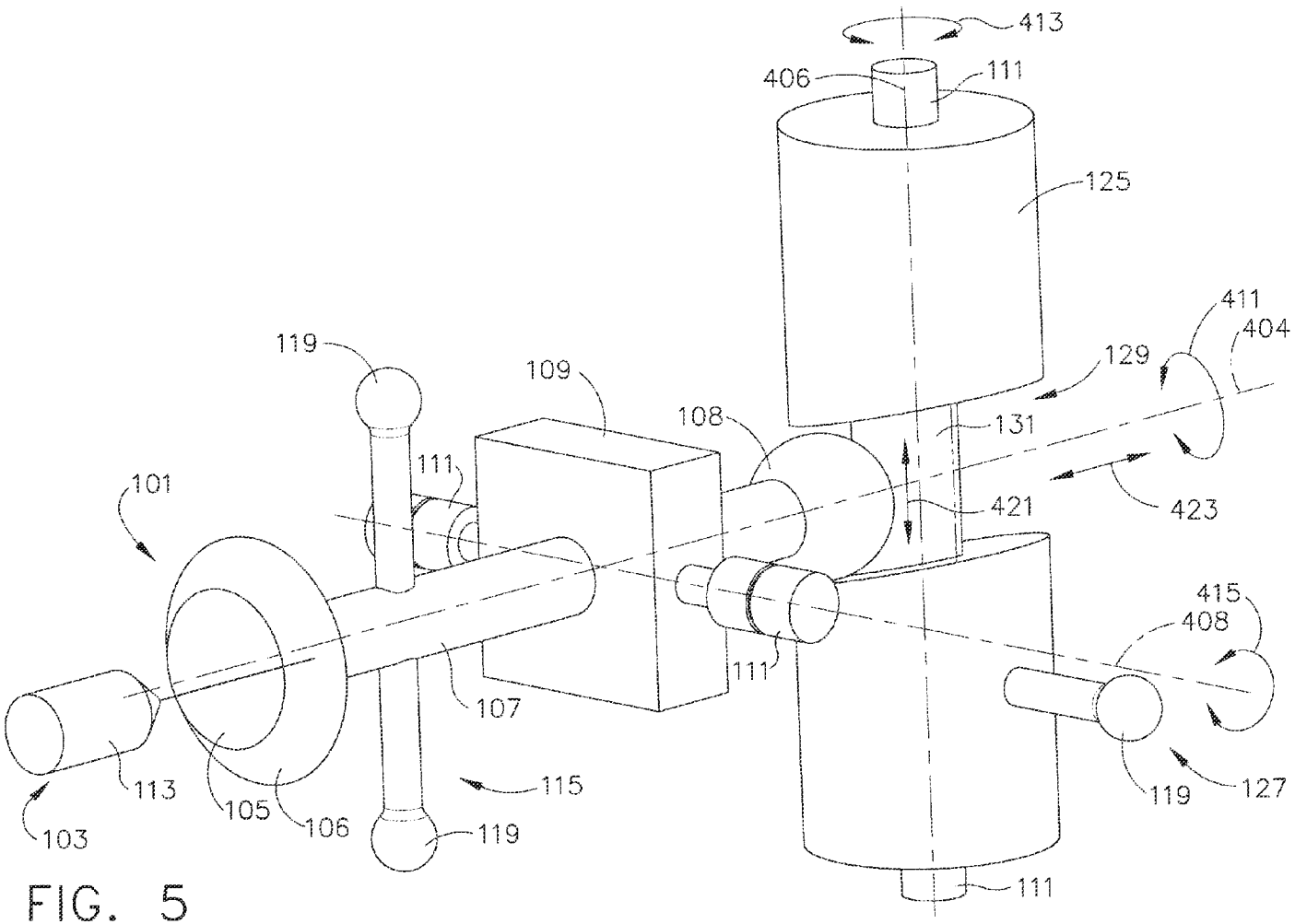
FIG. 5 shows a side perspective view of an anode assembly taken according to an embodiment of the present disclosure.

FIGS. 4 and 5 show two views of an anode target assembly 101 according to an embodiment of the present disclosure. The anode target assembly 101 shown in FIGS. 4 and 5 have the same arrangement of anode assembly 101 shown, in FIG. 1, including a first drive assembly 115, including ball portions 119, arranged to provide a oscillating motion 411 about a first axis 404. In addition, the anode assembly 101 includes a drive cylinder 125 having a second drive assembly 127, including ball portions 119, arranged to provide oscillating motion 413 about a second axis 406. As discussed above with respect to FIG. 1, the drive cylinder 125 includes a groove 129 having a slope, the slope having a slope angle 419. The slope angle 419 corresponds to the linear displacement desired from the pivoting support shaft 107. The slope angle 419 can be configured to correspond to the desired linear motion of the target 105. As the drive cylinder 125 oscillates with oscillating motion 413, the follower element 108 is driven by contact with the groove 129 in a linear direction 421, resulting in pivoting motion 415 of the support shaft 107 about third axis 408 and movement of the target 105 in linear direction 421. In addition; as discussed above with respect to FIG. 1, the drive cylinder 125 further includes a cam portion 131, which has a geometry offset from the second axis 406. The geometry of the cam portion 131, when in contact with the follower element 108, provides a linear motion 423 as the drive cylinder 125 oscillates with oscillating motion 413.

Figure 6:
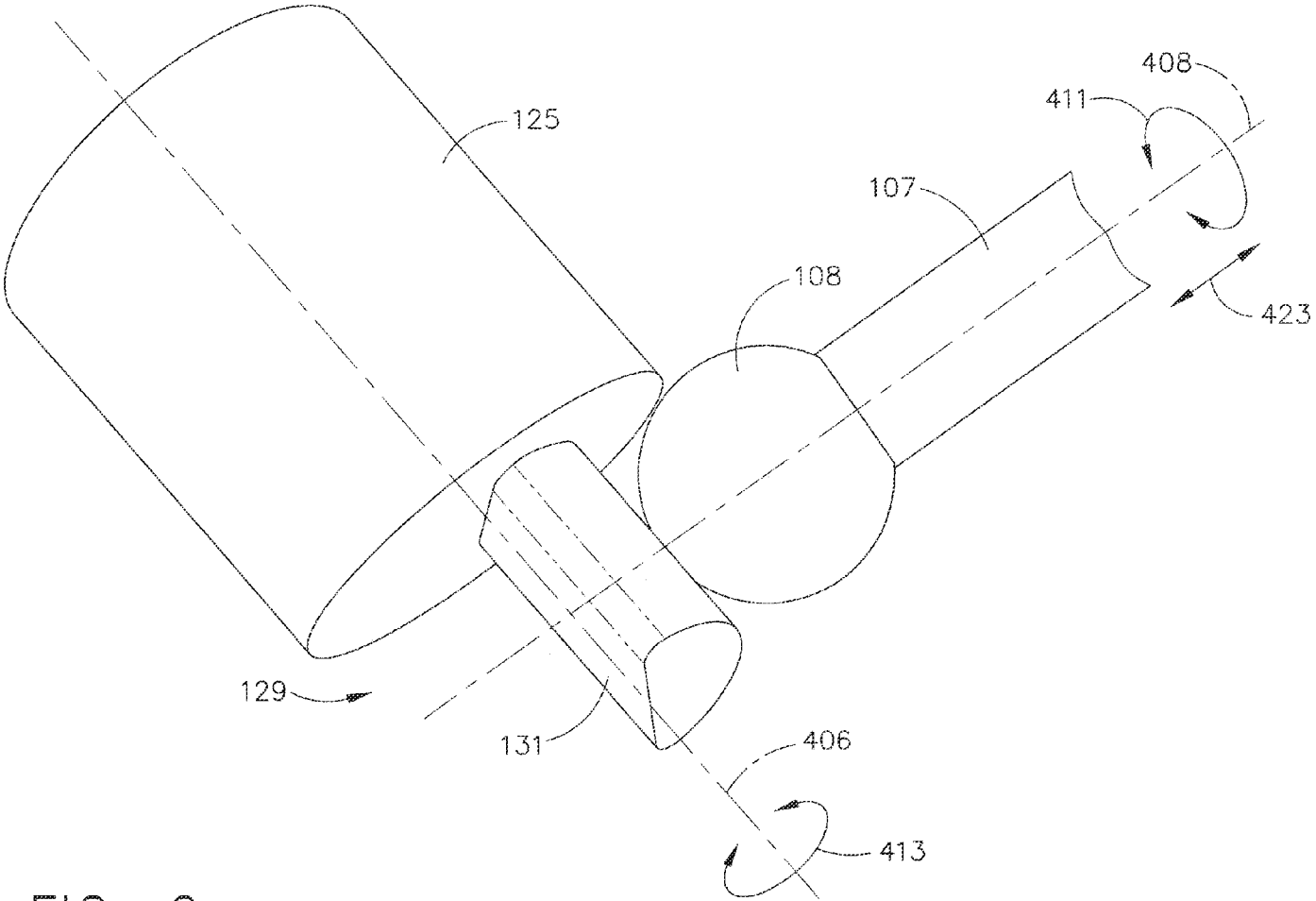
FIG. 6 shows a drive cylinder and cam according to an embodiment of the present disclosure.

FIG. 6 shows an enlarged view of a portion of the drive cylinder 125 and support shaft 107. The follower element 108 of support shaft 107 engages the cam element 131 of the drive cylinder 125. As the drive cylinder 125 oscillates with oscillatory motion 413, the follower element 108 and the support shaft 107 are urged in a linear direction 423. The contact between the follower element 108 and groove 129 and/or cam element 131 is maintained by a spring or other force providing device (not shown) mounted at the pivot assembly 109 or elsewhere.

Figure 7:
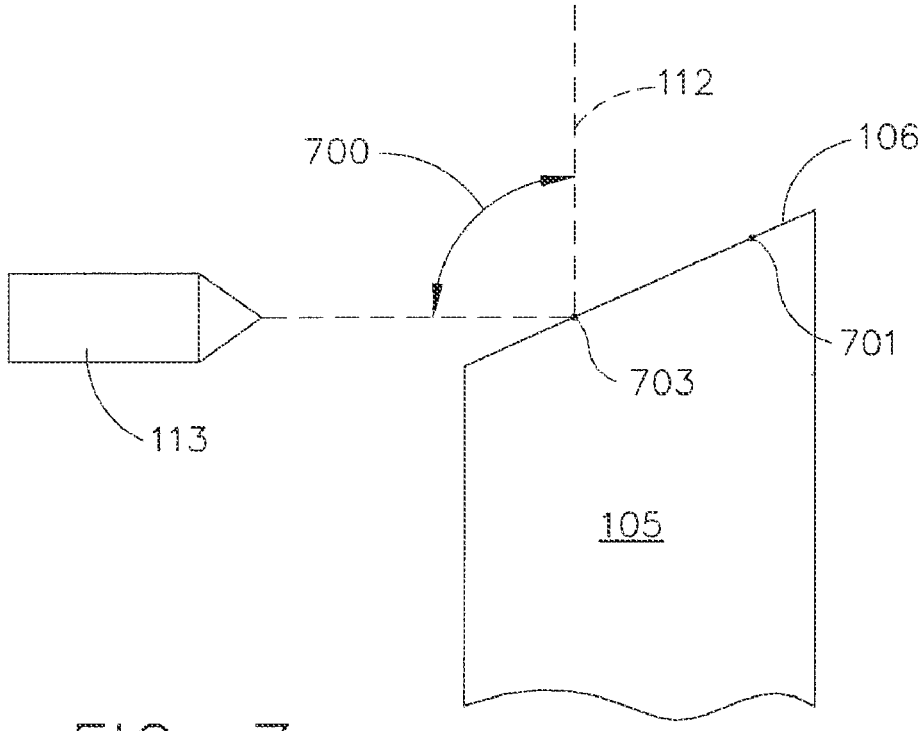
FIG. 7 shows a schematic view of the anode and cathode assembly according to an embodiment of the present disclosure.

FIG. 7 shows a schematic view of an anode target 105 arranged with respect to the electron emissive portion 113 of the cathode assembly 103. The target surface 106 provides an impingement angle 700 to which the electron beam 112 impinges (see e.g., FIG. 1) that is substantially constant and directs the X-radiation in the desired direction throughout the motion of the target 105. Since the position along the anode target 105 (i.e., focal point) is varied, the heat generated by the impingement of the electrons on the anode target 105 is permitted to dissipate over a larger area. Specifically, as shown, the range of motion extends from first focal point 701 to second focal point 703. Further, as shown schematically, the additional motion provided by the target assembly 101 of the disclosure further extends a focal path 801 between the first focal point 701 and the second focal point 703, providing an area 803 over which heat may be dissipated. This dissipation of heat permits the use of higher power and longer durations than are available with the use of a stationary anode arrangement. The target 105 is not limited to the geometry shown and may include segmented or otherwise curved geometry anode targets 105, for example, while not so limited, targets 105 may have a "butterfly" shape, or a multi-spot curved geometry, provided the target surface utilized maintains the substantially constant radius of curvature 601. Further, the focal path 801 is not limited to the elliptical path shown and may include other paths or paths of differing size. Other paths may include circular paths or non uniform or random paths throughout area 803.

Also, as discussed above, the particular arrangement of oscillatory couplings 111 or other pivoting structures is not limited to the arrangements shown and may include any pivoting or oscillatory motion providing structure that is capable of oscillating the anode target. Further, the present disclosure is not limited to pivoting motion provided through the use of a plurality of oscillatory coupling 111, but also includes direct actuation of the target 105 in a motion maintaining a fixed distance from the pivot point. For example, the target 105 may be affixed to first drive assembly 115 and/or second drive assembly 127, wherein the drive assembly 115 provides reciprocating rotation or oscillation of the target 105, such that the target surface 106 provides substantially constant production of X-rays from the electron beam 112. In addition, the present disclosure is not limited to the geometry of the targets shown and may include target geometries that provide an angled surface onto which the electron beam may be impinged. Further still, the present disclosure is not limited to a single focal point and may include multiple focal points.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

The invention claimed is:

1. An X-ray tube anode target assembly comprising:

a support shaft connected to a pivot assembly;

a movable anode target having a target surface disposed at one end of the support shaft and a follower element disposed at an opposite end of the support shaft;

a first drive assembly operably arranged with respect to the support shaft to provide oscillatory motion to the anode target about a first axis substantially parallel to the support shaft;

a drive cylinder operably arranged with respect to the follower element to provide a pivoting motion to the support shaft;

a second drive assembly operably arranged with respect to the drive cylinder to provide a oscillatory motion to the drive cylinder, the drive cylinder having a cam portion to provide a linear motion to the support shaft parallel to the first axis; and the target surface maintains a substantially constant angle of impingement and maintains a substantially fixed distance from a cathode during target motion.

2. The anode target assembly of claim 1, wherein the drive cylinder comprises a groove configured to contact the follower element and provide the support shaft with the pivoting motion.

3. The anode target assembly of claim 1, wherein the target surface is configured to provide a reflection X-ray generation.

4. The anode target assembly of claim 1, wherein the target surface is configured to provide a transmission X-ray generation.

5. The anode target assembly of claim 1, wherein the target has two or more segments each comprising the target surface.

6. The anode target assembly of claim 1, wherein one or both of the first drive assembly and second drive assembly includes an induction motor to provide oscillatory motion.

7. An X-ray tube assembly comprising:

an envelope having at least a portion thereof substantially transparent to X-ray;

a cathode assembly, operatively positioned in the envelope with an anode target assembly comprising:

a support shaft connected to a pivot assembly;

a movable anode target having a target surface disposed at one end of the support shaft and a follower element disposed at an opposite end of the support shaft;

a first drive assembly operably arranged with respect to the support shaft to provide oscillatory motion to the anode target about a first axis substantially parallel to the support shaft;

a drive cylinder operably arranged with respect to the follower element to provide a pivoting motion to the support shaft; and a second drive assembly operably arranged with respect to the drive cylinder to provide a oscillatory motion to the drive cylinder, the drive cylinder having a cam portion to provide a linear motion to the support shaft parallel to the first axis; and the target surface maintains a substantially constant angle of impingement and maintains a substantially fixed distance from the cathode assembly during target motion.

8. The X-ray tube assembly of claim 7, wherein the drive cylinder comprises a groove configured to contact the follower element and provide the support shaft with the pivoting motion.

9. The X-ray tube assembly of claim 7, wherein the target surface is configured to provide a reflection X-ray generation.

10. The X-ray tube assembly of claim 7, wherein the target surface is configured to provide a transmission X-ray generation.

11. The X-ray tube assembly of claim 7, wherein the target has two or more segments each comprising the target surface.

12. The X-ray tube assembly of claim 7, wherein one or both of the first drive assembly and second drive assembly includes an induction motor to provide oscillatory motion.

13. A method for providing heat management to an X-ray assembly comprising:

providing an X-ray tube assembly having:

an envelope having at least a portion thereof substantially transparent to X-ray;

a cathode assembly, operatively positioned in the envelope;

an anode target assembly comprising:

a support shaft connected to a pivot assembly;

a movable anode target having a target surface disposed at one end of the support shaft and a follower element disposed at an opposite end of the support shaft;

a first drive assembly operably arranged with respect to the support shaft to provide oscillatory motion to the anode target about a first axis substantially parallel to the support shaft;

a drive cylinder operably arranged with respect to the follower element to provide a pivoting motion to the support shaft; and a second drive assembly operably arranged with respect to the drive cylinder to provide a oscillatory motion to the drive cylinder, the drive cylinder having a cam portion to provide a linear motion to the support shaft parallel to the first axis; and providing motion to the anode target assembly and maintaining a substantially constant angle of impingement and maintaining a substantially fixed distance from the cathode assembly during target motion.

14. The method of claim 13, wherein the oscillatory motion includes a rotational motion about the first axis.

15. The method of claim 13, wherein the pivoting includes an oscillatory motion about a second axis.

16. The method of claim 15, wherein the pivoting includes an oscillatory motion about a third axis.

* * * * *